United States Patent [19]

Vogelsberg

[11] 4,272,951

[45] Jun. 16, 1981

[54] APPARATUS FOR THE SZ TWISTING OF POWER CABLE CONDUCTORS WITH SECTOR-SHAPED CONDUCTOR CROSS SECTION

[75] Inventor: Dieter Vogelsberg, Coburg, Fed. Rep. of Germany

[73] Assignee: Siemens Aktiengesellschaft, Munich, Fed. Rep. of Germany

[21] Appl. No.: 59,194

[22] Filed: Jul. 20, 1979

[30] Foreign Application Priority Data

Jul. 28, 1978 [DE] Fed. Rep. of Germany ..... 2833704
May 22, 1979 [DE] Fed. Rep. of Germany ..... 2921092

[51] Int. Cl.[3] ..... H01B 13/04
[52] U.S. Cl. ..... 57/293
[58] Field of Search ..... 57/293, 294

[56] References Cited

U.S. PATENT DOCUMENTS

| | | | |
|---|---|---|---|
| 3,481,127 | 12/1969 | Vogelsberg | 57/294 |
| 3,491,525 | 1/1970 | Sugi | 57/294 |
| 3,507,108 | 4/1970 | Yoshimura et al. | 57/294 |
| 3,593,509 | 7/1971 | Feese et al. | 57/293 |
| 3,823,536 | 7/1974 | Vogelsberg et al. | 57/294 |
| 3,884,025 | 5/1975 | Oberender et al. | 57/293 |
| 4,171,609 | 10/1979 | Feese | 57/293 |

FOREIGN PATENT DOCUMENTS

| | | |
|---|---|---|
| 1790249 | 4/1972 | Fed. Rep. of Germany . |
| 2412199 | 9/1975 | Fed. Rep. of Germany . |

*Primary Examiner*—John Petrakes
*Attorney, Agent, or Firm*—Kenyon & Kenyon

[57] ABSTRACT

For SZ twisting power cable conductors with a sector shaped conductor cross section which are not pre-twisted, two twisting heads are used which form a stretched accumulator and are arranged, respectively, after or before a twisting closer and revolve synchronously with changing rotary motion. Ahead of the first twisting point, a positive guide is arranged for each cable conductor. The positive guides and the twisting heads are arranged at a distance as short as possible from the twisting points. In this manner, an exact twisting geometry of the twisted assembly in the vicinity of the reversal points of the twist direction is obtained.

7 Claims, 4 Drawing Figures

APPARATUS FOR THE SZ TWISTING OF POWER CABLE CONDUCTORS WITH SECTOR-SHAPED CONDUCTOR CROSS SECTION

BACKGROUND OF THE INVENTION

The invention relates to the manufacturing of electric cables in general and more particular to the SZ twisting of power cable conductors of sector-shaped cross section with special consideration of the mechanical forces occurring in this process.

To better utilize the space in the cable cross section, it is customary in multi-conductor power cables in the low and medium voltage range (up to 10 kV), to use cable conductors of sector shaped cross section. These are twisted together with constant direction of twist to form the cable core. Sector conductors with or without initial twist can be used. Sector conductors without a pre-twist are twisted together without back twisting; strong torsional stresses then act on the sector conductors during the twisting process. Sector conductors with pre-twist are twisted together with back twisting; then, the torsional stresses are relatively low ("Kabel- und Leitungsfertigung", Kombinat VEB Kabelwerk Oberspree, VEB-Verlag Technik Berlin, 1976, page 200). In twisting sector conductors, it is customary to arrange a positive guide ahead of the twisting closer in order to fix their position in space required for the twisting. Such a positive guide can consist of several profiled rollers which are arranged one behind the other in a straight line and between which the respective conductor runs (DE-OS No. 22 11 111).

Besides the customary twisting of the sector conductors with constant twist direction, a type of twisting is also known, in which the sector conductors are twisted with a twist direction which changes at intervals. Such a type of twisting has found acceptance in recent years under the designation "SZ twisting" in the manufacture of communication cables and power lines, but the SZ twisting machines developed for this purpose cannot be employed without appropriate further development for the twisting of sector conductors, as large mechanical forces must be controlled in the twisting of sector conductors because of the large conductor cross section (more than 35 $mm^2$).

In one heretofore known apparatus for the SZ twisting of sector conductors without a pre-twist, there is provided as the twisting tool proper an oscillating twisting disc arranged ahead of the twisting closer, which is coupled to positive guides for the sector conductors. With such a twisting equipment, naturally only one to two lengths of lay of twist can be generated for each direction of twist (DE-OS No. 25 14 033). It has further been proposed already to twist the sector conductors straightened ahed of the twisting closer by means of a twisting device arranged between a first and a second twisting closer. This device revolves with a direction of rotation changing at intervals, so that the sector conductors are twisted a first time in the first twisting closer and a second time in the same direction in the second twisting closer. The twisting closer consists of one or two collet pull-off devices arranged one behind the other. Optionally, non-rotating collet pull-off devices can be arranged between the twisting points of the twisting machine, in order to always ensure equal distances between the stationary and rotating parts of the twisting machines which are responsible for the twisting, for the purpose of obtaining constant length of lay.

The direction of rotation of the twisting device is changed at intervals which are matched in a manner known per se to the storage capacity if the device (British Pat. No. 2,004,575).

For SZ twisting round line conductors of larger cross section, an SZ twisting machine is also known which contains two twisting tools, namely, an oscillating hole plate and an oscillating rotating twisting head in the form of a caterpillar pull or a three-pulley arrangement. While the hole plate is arranged in front of a first twisting closer, and the twisting head is located between the first and the second twisting closer (DE-OS No. 24 12 199).

There is further known, for SZ twisting conductors for communication cables, a twisting method in which the elements to be twisted are stranded by means of a stretched accumulator of varying rotary motion. The stretched accumulator consists of two twisting heads arranged between two twisting closers. The direction of rotation or the speed of rotation of the twisting heads is changed at intervals which are matched to the storage length of the accumulator (British Pat. No. 1,095,434; U.S. Pat. No. 3,823,536). For such twisting purposes, twisting heads can also be used which are designed in the manner of a caterpillar pull-off device (DE-OS No. 17 90 249) or consist of a deflection pulley over which the material to be twisted is looped once and is arranged tangentially to the twisting axis (U.S. Pat. No. 3,593,509).

SUMMARY OF THE INVENTION

It is an object of the present invention to improve the already proposed twisting apparatus for the SZ twisting of power cable conductors with a sector shaped conductor cross section which are not pre-twisted in such a manner that the material to be twisted has, in the vicinity of the reversal points of the twist direction, an exact twisting geometry and that these reversal points are made as short as possible.

The present invention therefore starts out from apparatus for the SZ twisting of power cable conductors with a sector shaped conductor cross section, which consists of stationary conductor supplies, of a first twisting closer and a positive guide arranged in front of the latter for each cable conductor, and of a second twisting closer (twisting point), of two twisting devices (twisting heads) which are associated with the two respective twisting closers and revolve synchronously with changing rotary motion, and of a pull-off and wind-up device, and in which the distance between the first twisting closer and the first engagement point of the first twisting device is equal or approximately equal to the distance between the last engagement point of the second twisting device and the second twisting closer. According to the present invention, it is provided that the twisting devices and the positive guides are arranged immediately after or ahead, respectively, of the twisting closer or twisting point; and that the distance between the last engagement point of each positive guide at a cable conductor and the first engagement point of the first twisting device at the material to be twisted is smaller than or at most equal to the length of lay of the material to be twisted which is given by the pull-off velocity and the speed or speeds of rotation of the twisting device, preferably smaller than or at most equal to one-half the length of lay.

With apparatus designed in this manner, the sector conductors are effectively twisted together over a short distance, the lengths of the torsion reversal points in the individual cable conductors being matched to the length of the twist reversal points of the twisted together cable conductors. In this respect, the present invention is based, among other things, on the consideration that the second twisting of the twisted assembly proceeds in the area of the second twisting closer without disturbance if the first twisting in the area of the first twisting closer has led to an exact twisting geometry. It is assumed that the change in the rotary motion of the twisting heads is matched exactly to the distance of the two twisting closers and twisting heads, i.e., to the stored length of the stretched accumulator formed by the twisting closers and twisting heads.

A twisting geometry as exact as possible is obtained if the torsion of the cable conductors which are not back twisted and the formation of torsion reversal points as well as the twist reversal points take place over a length of path as short as possible and the forces required therefor attack not only at the outer surface of the cable conductors combined in a stranded assembly, but also at the individual cable conductors themselves as long as the latter are still untwisted. The distance, held as short as possible, should in no case be larger than the length of lay of the twisted cable conductors. In view of the lengths of lay customary in sector conductor cables in the order of about 150 cm, this means that the distance between the positive guides and the twisting device is 60 to 10 cm to the extent possible.

To optimize the distance ratio, depending on the kind of sector conductors to be twisted, it is advisable to position the positive guides and/or the twisting heads relative to the twisting closers so that they can be varied or adjusted independently of each other.

To develop a clean twisting geometry, the first rotating twisting head and the positive guides for the cable conductors should further be close together, as already mentioned. In that case, the force flows from the rotating twisting head via the material to be twisted to the positive guides over spatially relatively closely limited paths. So that no damage to the conductors occurs, the individuals machine parts must be designed carefully. So that the positive guides can be arranged as close to the twisting closer as possible, it is therefore advisable to design them in the form of several profiled guide rollers which are arranged along a wavy line always on the inside of the wavy line. Some of the guide rollers arranged on both sides of the wavy line can be opposite each other in pairs or in the gaps, especially in a region, in which the curvature of the wavy line changes. If the positive guide is designed in this manner, the longitudinal forces acting during the pulling-off motion of the cable conductors are converted into transversal forces.

Especially large forces can be taken up by a positive guide if the latter consists of two deflection pulleys arranged one after the other, on which the respective cable conductor lies with a looping angle of at least 90°. Such deflection pulleys provided with a profiled groove permit a particularly gentle treatment of the sector shaped cable conductors. In order to avoid too long a distance between the last deflection pulley and the twisting close, this distance can be bridged by one or several profiled guide rollers; these guide rollers are advantageously arranged along a curved line, so that the respective cable conductor is pressed against these profiled rollers by conversion of longitudinal forces into transversal forces.

The twisting heads arranged after or in front of the twisting closers must likewise be designed in view of transmitting forces as large as possible for an arrangement as close as possible to the twisting closers. Suitable for this purpose are caterpillar arrangements or clamping jaw or collet devices. Advantageous in view of gentle handling of the material to be twisted is also the use of a one pulley twister which consists of a deflection pulley over which the material to be twisted is looped once, and which is arranged approximately symmetrically to the twisting axis. Since the material to be twisted is deflected in this case from the twisting axis, very large torsion forces can be transmitted to the material to be twisted, utilizing the lever action. In order to locate the point of attack of such a twisting head as close as possible to the twisting closer, it is necessary then to associate with the deflection pulley one or several guide rollers for feeding and taking off the material to be twisted.

BRIEF DESCRIPTION OF THE DRAWINGS

Embodiment examples of the new SZ twisting apparatus are shown in FIGS. 1 to 4.

DETAILED DESCRIPTION OF THE INVENTION

The apparatus shown schematically in the figures consists essentially of design elements with which those skilled in the art are familiar, such as reels, holes plates, deflection pulleys, positive guides, twisting closers, twisting heads, caterpillar tracks, or collets pull-off devices extruders water cooling sections and pulling-off and winding up devices. The design of these components therefore is not shown in detail.

Figure 1:
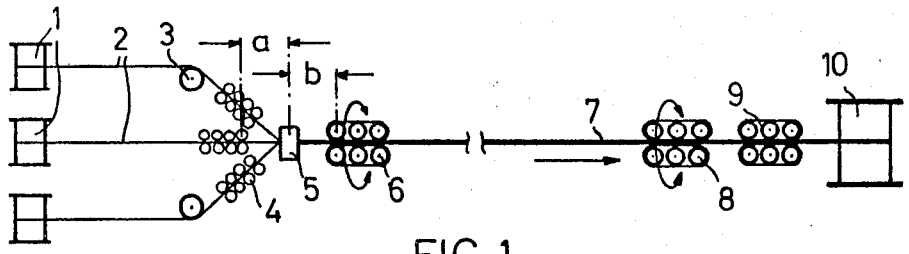
FIG. 1 is a schematic diagram of twisting apparatus according to the present invention.

The apparatus shown in FIG. 1 serves for twisting three power cable conductors 2 to form a twisted assembly 7. The plastic insulated cable conductors 2 are of sector-shaped cross section and are not pre-torsioned. They run off from stationary conductor supplies and are fed to the twisting closed 5 via deflection pulleys 3 and positive guides 4.

Behind the twisting closer 5 and ahead of the pulling off device 9, which forms one twisting point, twisting heads 6 and 8 are arranged which grip the cable conductors brought together in the twisting closer 5 tensionally from the outside and torsion or twist them together. Each twisting head consists of a caterpillar track arrangement or an arrangement in the manner of a collet pulling off device. The caterpillar tracks or collets are driven by the material to be twisted which passes through at constant pull-off speed v in the direction of the twisting axis, but can also be driven externally and move the material to be twisted in the lengthwise direction of the twisting axis. The rotary motion, i.e., the speed of rotation or the direction of rotation, of the twisting heads 6 and 8 is changed synchronously at intervals which are matched in the known manner to the running time of a longitudinal element of the material to be twisted from the first to the second twisting closer or the first to the second twisting head, respectively. After passing through the twisting head 8, the material to be twisted is gripped by the pulling-off device 9 and is wound on the wind up device 10.

In the region between the twisting heads 6 and 8, untwisting of the reversal points of the twist direction of the material to be twisted under the influence of tension stresses is not expected, since the cable conductors 2 are plastically deformed in the vicinity of the reversal points and thus insure a stable twisting geometry. Optionally, however, special guide elements can be arranged between the twisting heads 6 and 8. Furthermore, the pulling-off device 9 can be omitted if one or both of the alternatingly rotating twisting heads take over its function. A deflection pulley or the like must then be provided as the second twisting point.

The effective distance of the twisting head 6 from the twisting closer 5 is designated as b and the effective distance of the positive guide 4 from the twisting closer 5 as a. The sum of the distances a and b and therefore, also the length c between the twisting head 8 and the twisting point formed by the pull off 9 should be smaller than one length of lay of the material to be twisted.

In the apparatus shown in FIG. 1, the positive guides 4 consist of groups of rollers which are disposed opposite each other in pairs, the individual rollers having a profile, and these profiles being matched exactly to the cross section of the sector conductor 2. The profile and the contact pressure between the groups of rollers prevent the sector conductors 2 from turning in the zone of the positive guides 4. The longitudinal motion of the sector conductors is not impeded.

Figure 2:
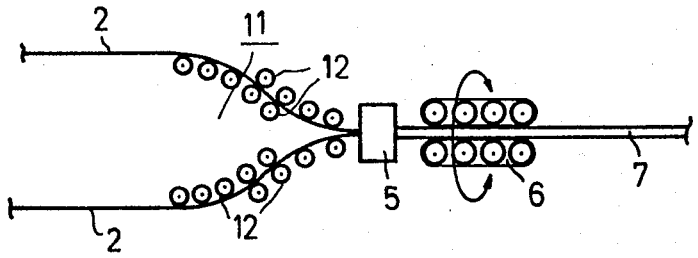
FIG. 2 illustrates a further embodiment of positive guides which can be used with the apparatus of FIG. 1.

In FIG. 2, positive guides 11 are shown which also consist of profiled deflection rollers 12. These deflection rollers, however, are arranged on a wavy line, in particular, on a line bent in an S-shape, so that the longitudinal forces effective due to the pulling off motion are converted into transversal forces by the deflection of the cable conductors obtained thereby. It is therefore not necessary to press the profiled rollers 12 specially against the cable conductors. In the region of the curvature change of the wavy line, the deflection rollers are disposed opposite each other in paris or in the gaps. The advantage of such an arrangement is that a particularly small distance between the last guide roller of a positive guide 11 and the twisting closer 5 can be obtained.

Figure 3:
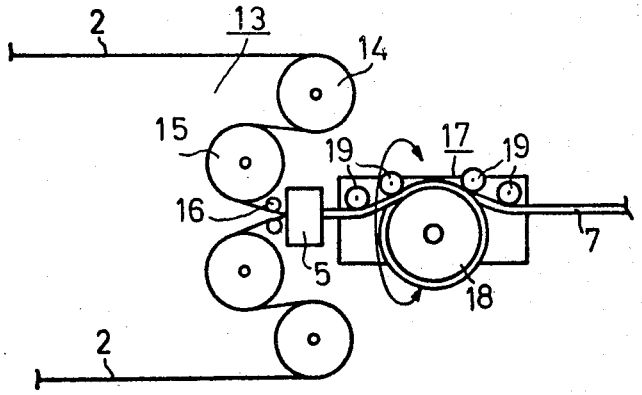
FIG. 3, illustrates another type of positive guide which can take up particularly large forces.

FIG. 3 shows a positive guide 13 which can take up particularly large forces. For this purpose, two relatively large profiled deflection pulleys 14 and 15 are provided which are arranged in tandem and over which a cable conductor is looped over an angle of about 180°. The distance between the running off point of a cable conductor on the second deflection pulley 15 and the twisting closer 5 is advantageously bridged by means of one or several profiled guide rollers 16. It is advisable to arrange the guide roller 16 in such a manner that the cable conductor is conducted on a curved line on the path from the deflection pulley 15 to the twisting closer.

FIG. 3 shows at the same time an advantageous embodiment of a twisting head 17 arranged advantageously behind the twisting closer 5. This twisting head is constructed in the manner of a single pulley twister and consists of the deflection pulley 18 over which the material to be twisted is looped once and with which two guide rollers 19 are associated for feeding and taking off, respectively. While such a twisting head requires relatively large transverse dimensions, depending on the diameter of the material to be twisted, speeds of revolution of the twisting head in the order of 10 to 60 RPM are obtained with a pull-off velocity of, say 40 to 70 m/min, in view of the length of lay of about 1.5 m provided for cable conductors with a conductor cross section of, for instance, 150 $mm^2$. The inertial forces of such a twisting head occurring in the twisting are substantially smaller, however, than in the case of conventional twisting with revolving reels.

The profile of the deflection pulley 18, which may optionally also be designed as a pulling-off pulley, is made slightly conical. The center of gravity of the deflection pulley is preferably somewhat outside the twisting axis.

Figure 4:
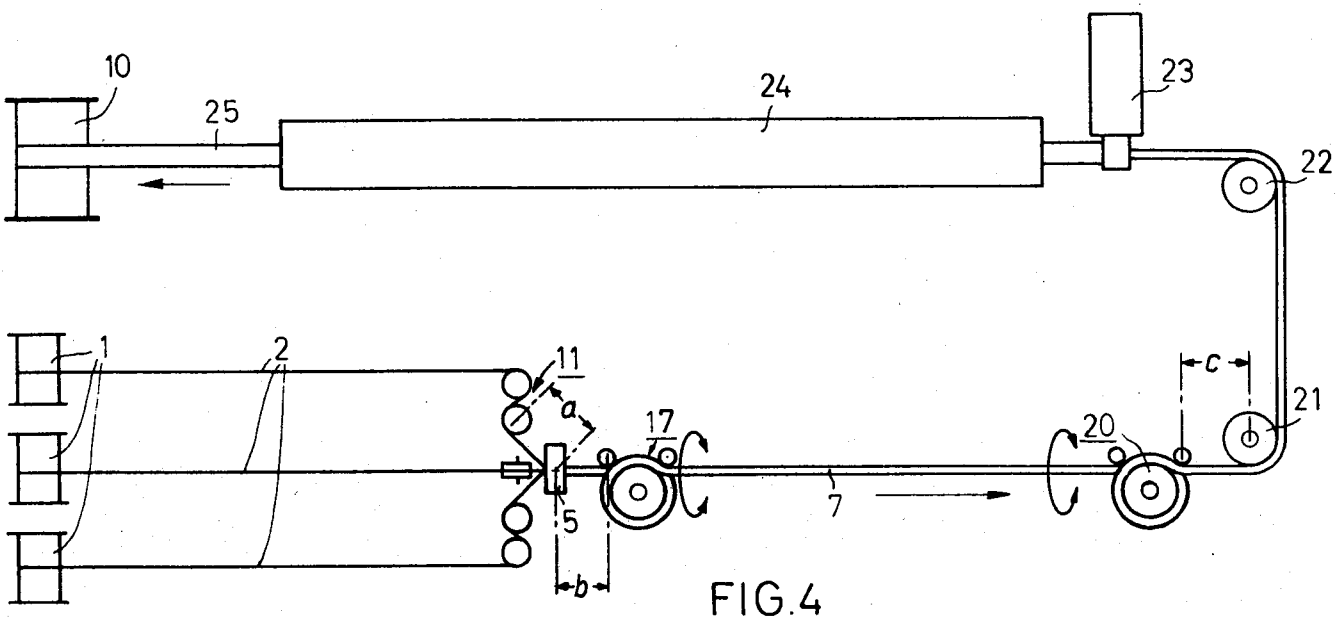
FIG. 4 illustrates twisting apparatus combined with an extrusion process for the twisted cable.

FIG. 4 shows apparatus, in which the twisting of the cable conductors 2 into a twisted assembly 17 is combined with an extrusion process for applying the cable sheath and with which, accordingly, a complete cable 25 can be manufactured from cable conductors 2. To this end, the twistin portion, which agrees essentially with the devices shown in FIGS. 1 and 3 and comprises the two twisting heads 17 and 20, is followed by an extrusion line which consists of the extruder 23 and the water cooling trough 24 and extends parallel to the twisting section, and to which the twisted assembly 7 is fed via the deflection pulleys 21 and 22. As a modification of this embodiment, the possibility of combining the twisting of the cable conductors 2 with the extrusion of the conductor insulation by letting conductor strands run off from the supply reels 1 and jacketing them immediately subsequently by means of an extruder and a water cooling section, as is described in DE-AS No. 28 33 702 also exists.

In SZ twisting of sector conductors by means of a twisting machine, the twisting heads of which merely change their speed of rotation but not their direction rotary motion, the pull-off velocity and the speeds of rotation can be matched to each other in such a way that the length of lay of the twisted material in the region of the twisting apparatus is, for instance, alternatingly +66 cm and +200 cm, so that a length of lay of +100 cm is obtained in the finished twisted material. With the direction of lay remaining the same within the twisting apparatus, it is ensured that large transversal forces can be transmitted by the twisting heads to the material to be twisted, without the elements to be twisted (sector conductors) arranging themselves parallel in a plane in the region of the twist reversal points.

What is claimed is:

1. In apparatus for the SZ twisting of power cable conductors with a sector-shaped conductor cross section, including:

stationary conductor supplies, a first twisting closer and a stationary positive guide for each cable conductor arranged in front thereof; and a second twisting closer;

two twisting devices arranged between the twisting closers, and associated respectively with the two twisting closers;

means to cause said twisting devices to revolve synchronously with changing rotary motion; and a pulling-off and winding-up device, the distance between the first twisting closer and the first point of engagement of the first twisting device being equal or approximately equal to the distance between the last point of engagement of the second twisting device and the second twisting point, the improvement comprising:

the twisting devices being arranged immediately after and immediately ahead of their respective twisting closers; and the distance between the last point of engagement of each positive guide at a cable conductor and the first point of engagement of the first twisting device at the material to be twisted being smaller than or at most equal to the length of lay of the material to be twisted given by the pulling off velocity and the speed of revolution of the twisting device, and preferably smaller than or at most equal to one half the length of lay.

2. The improvement according to claim 1, wherein the distance between each positive guide and the twisting closer and the distances between the twisting closers and the twisting devices can be adjusted independently of each other.

3. Apparatus according to claim 2, wherein each positive guide comprises two deflection pulleys on which the respective cable conductor lies with a looping angle of at least 90°.

4. Apparatus according to claim 3, wherein one or more profiled guide rollers are arranged between the second deflection pulley and the twisting closer.

5. Apparatus according to claim 1, wherein each positive guide comprises several profiled guide rollers which are arranged along a wavy line always on the inside of the wavy line.

6. Apparatus according to claim 5, wherein some of the guide rollers arranged on both sides of the wavy line are disposed opposite each other in pairs or in the gaps.

7. Apparataus according to claim 1 wherein each twisting device comprises a deflection pulley, over which the twisted material is looped once and which is arranged approximately symmetrically to the twisting axis, and with which one or more guide rollers are associated for feeding and taking off the twisted material.

* * * * *